US009380668B2

(12) United States Patent
Tyrrell

(10) Patent No.: US 9,380,668 B2
(45) Date of Patent: Jun. 28, 2016

(54) PDM MODULATION OF LED CURRENT

(71) Applicant: Dialog Semiconductor GmbH, Kirchheim/Teck-Nabern (DE)

(72) Inventor: Julian Tyrrell, Cricklade (GB)

(73) Assignee: Dialog Semiconductor (UK) Limited, Reading (GB)

( * ) Notice: Subject to any disclaimer, the term of this patent is extended or adjusted under 35 U.S.C. 154(b) by 0 days.

(21) Appl. No.: 14/204,003

(22) Filed: Mar. 11, 2014

(65) Prior Publication Data

US 2015/0245438 A1 Aug. 27, 2015

(30) Foreign Application Priority Data

Feb. 24, 2014 (EP) ..... 14392001

(51) Int. Cl.
*H05B 41/16* (2006.01)
*H05B 33/08* (2006.01)

(52) U.S. Cl.
CPC ..... *H05B 33/0845* (2013.01); *H05B 33/0815* (2013.01); *H05B 33/0848* (2013.01)

(58) Field of Classification Search
CPC ..... H05B 33/0815; H05B 33/0818; H05B 33/0833; H05B 33/0839; H05B 33/0845
See application file for complete search history.

(56) References Cited

U.S. PATENT DOCUMENTS

| | | | | |
|---|---|---|---|---|
| 5,995,546 | A | 11/1999 | Richardson | |
| 6,115,731 | A | 9/2000 | Hendricks | |
| 6,573,666 | B1 * | 6/2003 | Killat | H05B 41/3921 315/224 |
| 7,915,838 | B2 * | 3/2011 | VanEss | H05B 33/0818 315/302 |
| 7,999,491 | B2 | 8/2011 | Peng et al. | |
| 8,358,084 | B2 | 1/2013 | Shiu et al. | |
| 8,362,706 | B1 | 1/2013 | Godbole | |
| 8,441,202 | B2 | 5/2013 | Wilson et al. | |
| 8,536,801 | B1 | 9/2013 | Dernovsek | |
| 2002/0167471 | A1 | 11/2002 | Everitt | |
| 2008/0018261 | A1 * | 1/2008 | Kastner | F21V 23/00 315/192 |
| 2010/0090618 | A1 * | 4/2010 | Veltman | H05B 33/0815 315/307 |
| 2010/0123403 | A1 * | 5/2010 | Reed | H05B 33/0815 315/193 |
| 2010/0231132 | A1 * | 9/2010 | Logiudice | H05B 33/0818 315/161 |
| 2011/0062877 | A1 * | 3/2011 | Yang | H05B 33/0845 315/219 |
| 2011/0095697 | A1 * | 4/2011 | Ludorf | H05B 33/0854 315/287 |
| 2011/0101877 | A1 | 5/2011 | Zhan et al. | |
| 2012/0062138 | A1 | 3/2012 | Wilson et al. | |
| 2013/0099684 | A1 | 4/2013 | Cheng et al. | |
| 2013/0113386 | A1 | 5/2013 | Hariharan | |

(Continued)

FOREIGN PATENT DOCUMENTS

WO WO 2011/056242 5/2011

OTHER PUBLICATIONS

European Search Report 14392001.5-1802 Mailed: Jul. 4, 2014, Dialog Semiconductor GmbH.

*Primary Examiner* — Jason M Crawford
*Assistant Examiner* — Kurtis R Bahr
(74) *Attorney, Agent, or Firm* — Saile Ackerman LLC; Stephen B. Ackerman

(57) ABSTRACT

A modulated current of an LED device provides a capability to dim of the light produced by a string of LED device. The current modulation takes the form of pulse width modulation (PWM) or pulse density modulation (PDM). The modulation is produced on the primary side of a transformer and coupled to the string of LED diodes that are coupled to the secondary side of the transformer. The modulation is varied to change the current of the LED devices and therefore the light intensity of the LED devices.

11 Claims, 4 Drawing Sheets

(56) References Cited

U.S. PATENT DOCUMENTS

2013/0119875 A1* 5/2013 Dearborn ..... H05B 33/0815 315/186
2013/0162224 A1* 6/2013 Eckel ..... H05B 33/0815 323/205
2013/0175929 A1 7/2013 Hoogzaad
2013/0221875 A1* 8/2013 Liao ..... H05B 33/0815 315/307
2013/0249440 A1* 9/2013 Doshi ..... H05B 33/0842 315/309
2014/0285092 A1* 9/2014 Knoedgen ..... H05B 37/0272 315/151

* cited by examiner

PDM MODULATION OF LED CURRENT

TECHNICAL FIELD

The present disclosure is related to LED light bulb and in particular input power control to enable that dim the illumination.

BACKGROUND

The growing popularity and proliferation of light bulbs formed with LED devices has directed attention to powering concepts. Incandescent light bulbs are primarily driven by voltage, whereas LED devices are primarily driven by current. This means that circuitry more complex than wires connecting a filament to a source of power is required, and if light dimming is required the circuitry becomes even more complex. Also this circuitry complexity needs to be packaged in a small space to allow an LED bulb to replace an incandescent bulb in a fashion similar to which has been used by the incandescent bulb, for instance screwing an LED bulb into an incandescent "light" socket.

The technologies used to create an LED power dimming capability appear to be wide ranging from power factor control to a switch mode control using a tapped buck configuration. The objective is not only to be able to reduce the illumination from an LED bulb, but to reduce the illumination smoothly and flicker free. In some cases an audible noise, for instance a buzz or whistling, occurs caused by physical components or PCB stress at high current flow, and an increase in dimming resolution is needed. These problems detract from the utility of a LED light bulb and the ability to dim the illumination resulting from the light bulb.

In U.S. 2013/0175929 A1 (Hoogzaad) a method is directed to regulating an LED current flowing through a circuit containing an LED device. U.S. 2013/0113386 A1 (Hariharan) is directed to an LED illumination system comprising devices and methods of driving an LED. U.S. 2013/0099684 A1 (Cheng et al.) is directed to parallel channels of LED devices using a pulse control signal. U.S. 2012/0062138 A1 (Wilson et al.) is directed to an illumination apparatus comprising a plurality of LED devices and a control system connected to receive dimmer-modulated AC line voltage. U.S. 2002/0167471 (Everitt) is directed to a pulse width modulation driver for an organic LED display. U.S. Pat. No. 8,441,202 B2 (Wilson et al.) is directed to a plurality of LED devices and a control system connect to receive dimmer-modulated AC line voltage to control the LED devices. In U.S. Pat. No. 8,362,706 B1 (Godbole) an apparatus and method is directed to control current through one or more LED circuits, wherein a compensation unit functions to offset errors. U.S. Pat. No. 8,358,084 B2 (Shin et al.) is directed to an LED current control circuit comprising a current detecting unit, a current adjusting unit and a current control unit. U.S. Pat. No. 7,999,491 B2 (Peng et al.) is directed at providing a high precision lighting control means to drive an LED lighting module.

SUMMARY

It is an objective of the present disclosure to use pulse density modulation (PDM) to distribute the on-time of the LED devices over the entire cycle.

It is further an objective of the present disclosure to control the dimming of LED devices with control circuitry on the primary side of the LED power circuitry.

It is also an objective of the present disclosure use either pulse width modulation (PWM) or pulse density modulation (PDM) to control dimming of LED devices.

A bridge rectifier circuit is used to transform an AC voltage into a full wave rectified DC voltage to bias circuitry on a primary side of a transformer comprising a transistor controlled by a DC-DC controller. The DC-DC controller modulates the current on the primary side of the transformer with pulse density modulation (PDM) to produce a current on the secondary side of the transformer that is used to dim a string of at least one LED devices. On the secondary side of the transformer are located the string of at least one LED devices. The DC-DC controller uses a combination of drive current reduction and pulse density modulation (PDM) to transfer primary side energy through the transformer to the string of LED diodes. The PDM distributes the time that the LED devices are turned on over the whole period to eliminate strong fundamental repetition frequency and to ease loading on the previous driver stage.

A combination of drive current and PDM modulation is used to achieve a level of dimming of light emitted from the string of LED diodes. At a predetermined current level of the LED diodes, the drive current is maintained at a constant level, for instance 60%, at a fixed Ton/Tp, where Ton is the time the LED devices are on and Tp is the period of one cycle. At this point the duty cycle of the PDM modulation is reduced from 100% to further lower the LED current to approximately 1% and further dim the LED devices.

BRIEF DESCRIPTION OF THE DRAWINGS

This disclosure will be described with reference to the accompanying drawings, wherein.

DETAILED DESCRIPTION

Figure 1:
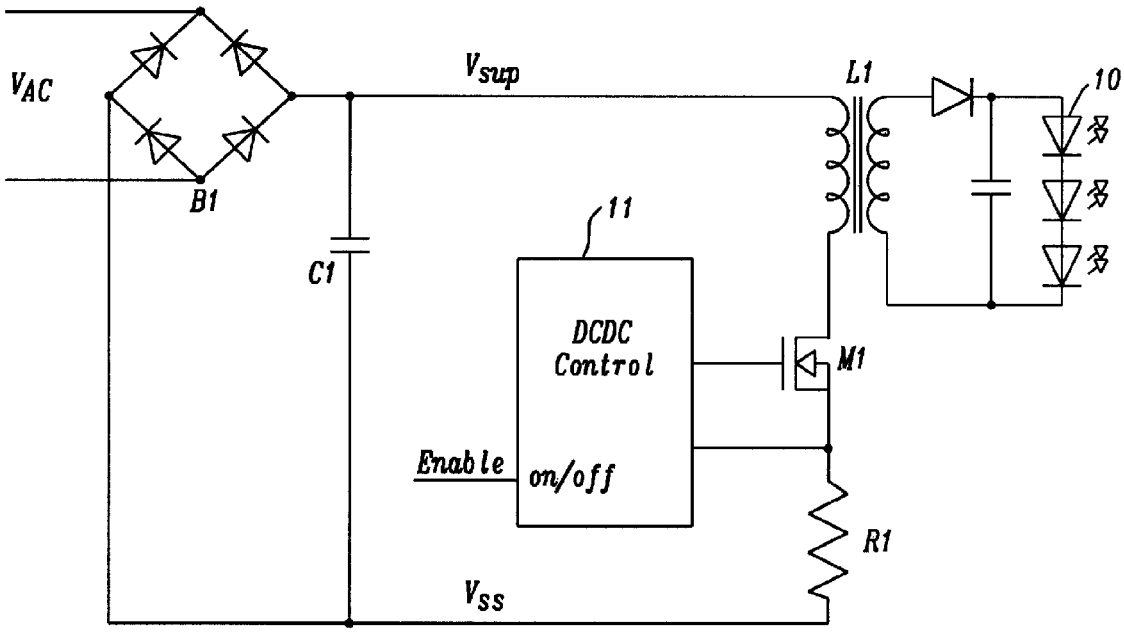
FIG. 1 is a circuit diagram of the present disclosure for primary side control for powering a string of LED devices.

FIG. 1 shows the circuitry used to drive a string of LED devices 10 comprising at least one LED device and using an AC input voltage with primary side control. The input voltage (for example 110 Vrms at 60 Hz) is converted from AC to a DC voltage with a bridge rectifier B1 and smoothed with capacitor C1. The resulting voltage, Vsup, is used to supply power to a DC-DC converter 11; which transfers power to the LED string 10 via transformer L1. The DC-DC control circuitry 11 switches the MOSFET transistor M1 and senses the primary coil current with resistor R1. By controlling the 'on' time of the MOSFET transistor M1 and the repetition frequency of the switching, the required power transfer from Vsup to the LED devices is established. As the power to the LED devices is reduced, for example when the LED devices are dimmed, the inaccuracy in the sensing of the primary coil current becomes more dominant and reduces the accuracy of the control, which limits the range of the linear power control.

Figure 2:
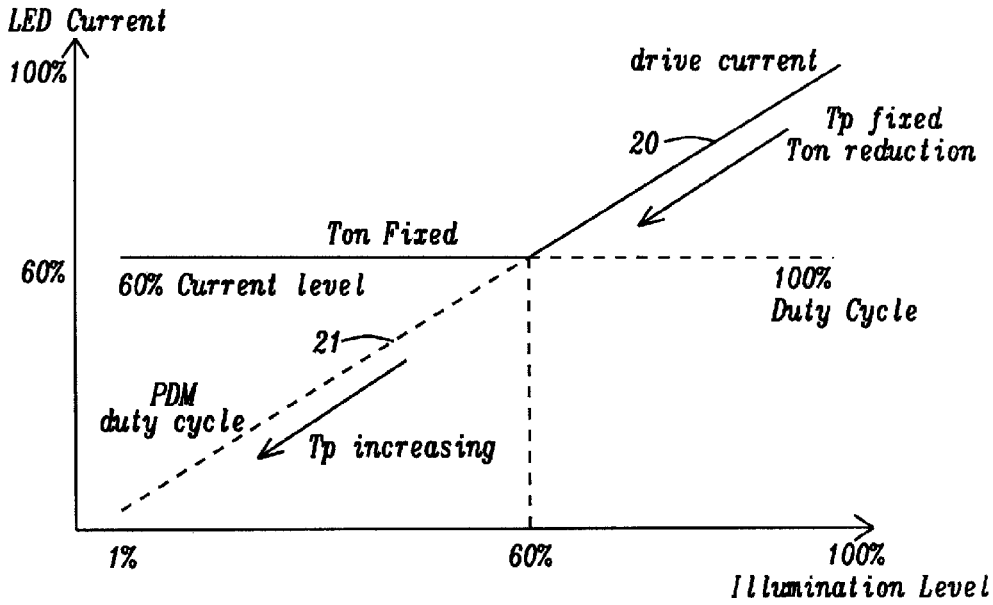
FIG. 2 is a graph of the present disclosure for producing current to drive an LED device and the resulting illumination level.

LED devices with primary-side regulation use a combination of drive current and PDM modulation to achieve a dimmable light level. The graph of FIG. 2 shows a representative dimming curve 20 from 100% to an intermediate level, for instance 60%, and a further dimming curve 21 from the intermediate level to 1% light levels. At the intermediate predetermined level, the drive current 20 is maintained at a constant level and the duty cycle of a PDM modulator is then reduced from 100% to lower the LED current further to approximately 1%. This example shows a transition at 60% LED current, which can be set at other levels. The graph shows the duty cycle dimming being the technique of PDM modulation.

Figure 3:
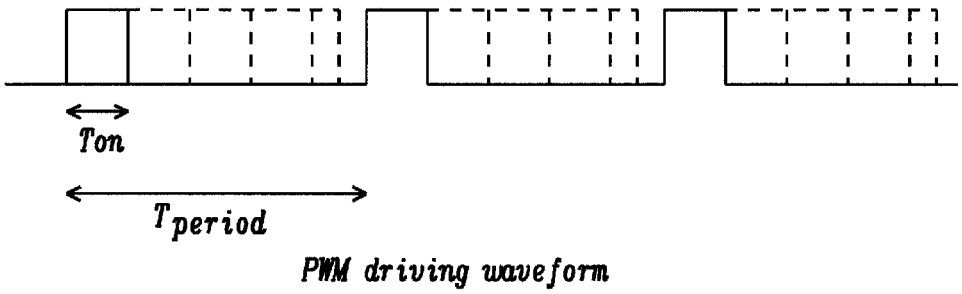
FIG. 3 is a series of pulse width variations of the present disclosure for a PWM driving waveform.

In FIG. 3 is shown a typical PWM (pulse width modulation) waveform, with the repetition period $T_{PERIOD}$ and the 'on' time as $T_{PWM}$. The ratio of $T_{PWM}$ to $T_{PERIOD}$ is the duty cycle. For typical LED device applications the $T_{PERIOD}$ is set to a frequency higher than the human visual flicker response (typically about 400 Hz). The resolution of the $T_{PWM}$ period, for the primary side regulation, will be set by the speed of the DC-DC converter that drives the LED devices; for example a 20 kHz converter rate with a 400 Hz period results in a 2% duty cycle step size.

Figure 4:
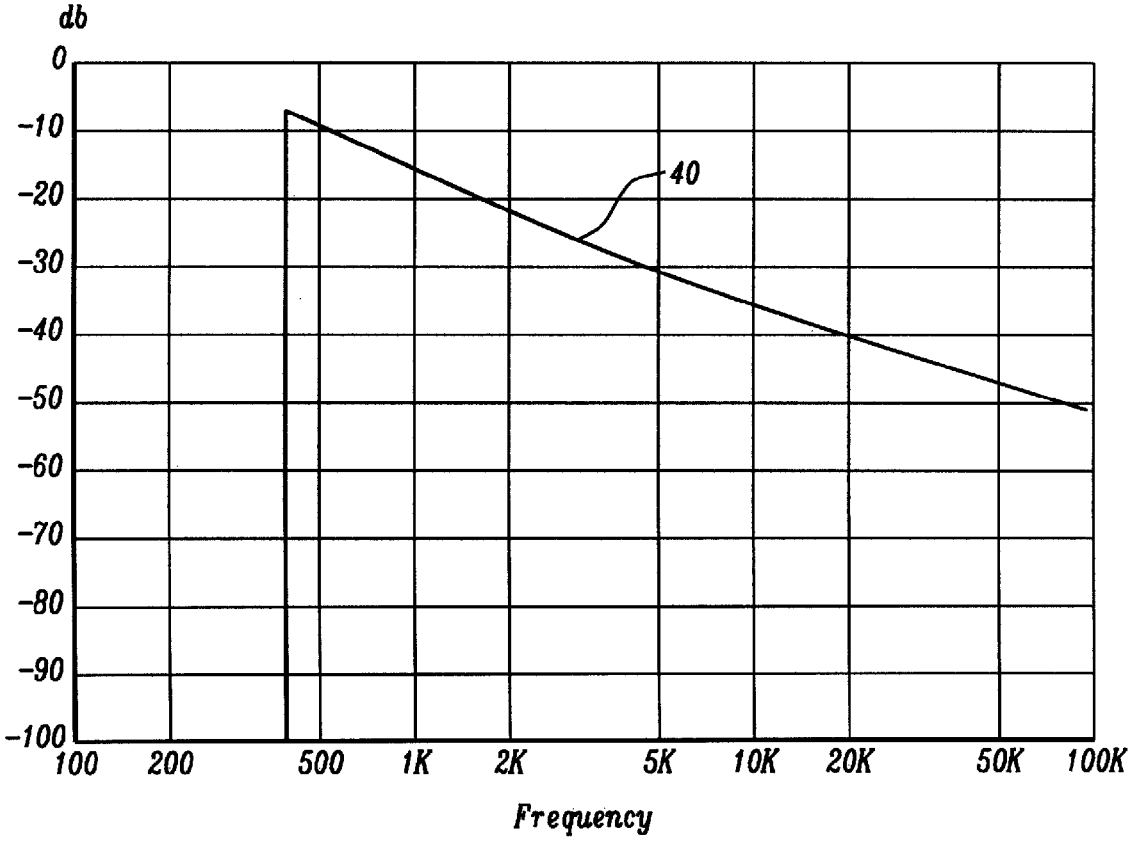
FIG. 4 is a graph of the present disclosure outlining the amplitude of the frequency spectrum of the PWM.

FIG. 4 shows a contour 40 of the maximum amplitude in decibels dB (a logarithmic scale) of the frequency spectrum of the PWM modulation, and shows that the majority of the energy is concentrated at the low-frequencies, which makes the visual flicker most noticeable as well as the possibility of stressing the components and/or printed circuit PCB tracking (wiring tracks) with the current pulses producing audible noise. The graph of FIG. 4 shows the frequency spectrum of a 60% duty cycle waveform with a 400 Hz repetition rate (with the data either 1 or 0), which clearly shows that the majority of the energy is in the low frequency end. It should be noted that the horizontal axis is frequency in logarithmic format and the vertical axis is amplitude in dB.

Figure 5:
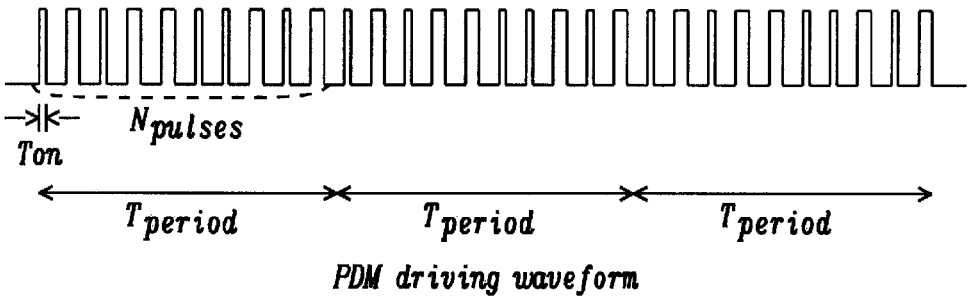
FIG. 5 is a series of pulses of the present disclosure for producing the PDM driving waveform.
Figure 6:
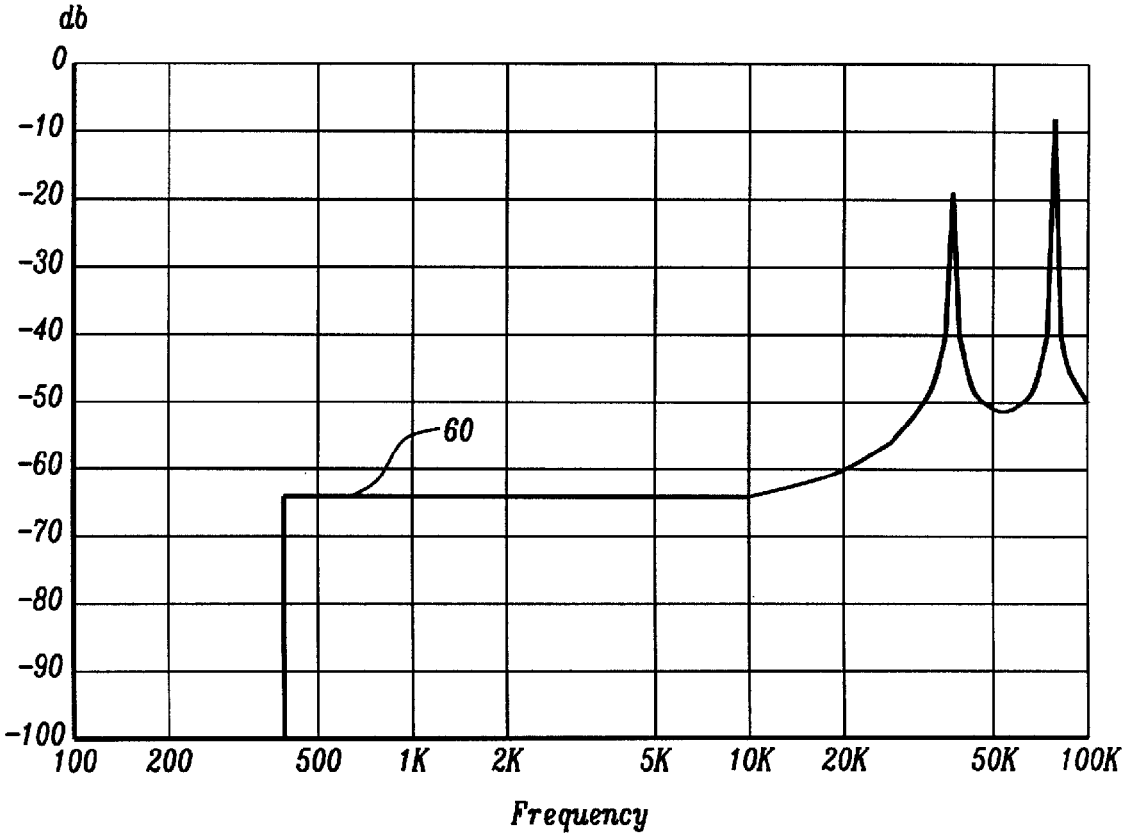
FIG. 6 is a graph of the present disclosure showing the outline amplitude of the frequency spectrum of the PDM.

In FIG. 5 is shown a PDM waveform in which the total 'on' time is given by the product of $T_{ON}$ and $N_{PULSES}$ within a $T_{PERIOD}$. The PDM modulation is based on integer mathematics, and any remainder is carried into the next TPERIOD, which eliminates any errors and maintains the correct waveform. The graph of FIG. 6 shows a contour 60 of the maximum amplitude in dB of the frequency spectrum of PDM modulation starting with the same 60% duty cycle waveform, 400 Hz repetition rate and with the data either a logical 1 or 0, as previously used with PWM. This frequency spectrum shows that the majority of the energy is now shifted towards the higher frequencies, with the characteristic noise shaping of a sigma-delta modulator. This example uses a first order modulator structure which reduces the 400 Hz component from −7 dB for the PWM waveform to a negative 65 dB for the PDM waveform. Again It should be noted that the horizontal axis is frequency in logarithmic format and the vertical axis is amplitude in dB. It should also be noted that the PDM modulation generates the same total "on-time" as was done with Tpwm within a Tperiod time as with PWM, but has the 'on' periods distributed evenly over the whole period. The waveform in FIG. 6 shows the contour 60 of the frequency spectrum for PDM modulation noted above.

The 'on' time $T_{ON}$ is synchronized with the DC-DC converter 11 switching due to the primary-side regulation control either at the switching frequency or a sub-multiple. This ensures that the generated waveform aligns with the switching frequency, which can help eliminate any sub-sampling harmonics from being generated.

The resulting repetition frequency of the PDM, i.e. $1/T_{PERIOD}$, which is the product of the $T_{ON}$ time and the modulator length (for example the accumulator count), can result in a lower repetition frequency than the PWM technique, as it has a lower spectral content at any visible flicker frequencies.

The pulsed current stressing of the components and/or PCB tracking, which can create noise at the lower audible frequencies, is significantly reduced, and higher resolution of the current duty cycle can be achieved by incorporating 'binary fractional' mathematics within the modulator. For example using a 10-to-8 bit dither over 4 consecutive DC-DC converter 11 switching cycles allows a 10-bit resolution of the current setting with an eight-bit resolution current limit DAC. By incorporating the additional ¼ LSB-weighting within the PDM modulation, accomplishes the same result with only an 8-bit current limit DAC without using four consecutive conversion cycles.

Figure 7:
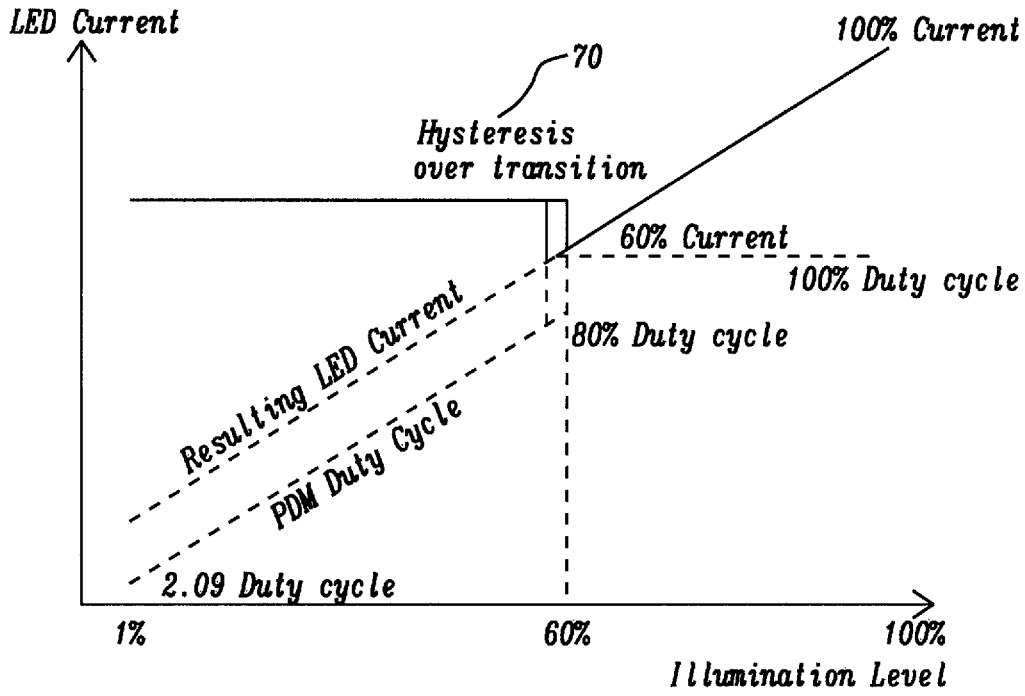
FIG. 7 is a graph of the present disclosure to shape the resulting spectrum and lower visible flicker frequencies.

A higher order of modulator structures can be used to shape the resulting spectrum and lower the visible-flicker frequencies with the trade-off to lower repetition ($1/T_{PERIOD}$) frequencies. However, there may be both significant repeating patterns at specific duty cycle ratios, as well as limitations to the generated pulse density that are well understood for various structures of modulators. The dimming curve graph can be modified to accommodate the limitation of the modulation depth by limiting the range of PDM duty cycle used, for example if the modulator is operated with a maximum of 80% duty cycle, the drive current can be increased as shown in FIG. 7.

The hysteresis 70 in the transition between linear current using a fixed duty cycle and variable duty cycle provides a benefit when the dimming level is set to the transition point. As the dimming level is changed from a fixed duty cycle to a variable duty cycle and visa versa, there is a degree of matching that must take place so as not to produce a noticeable jump in brightness, which may produce a "jitter" in the brightness at the transition between the fixed duty cycle and the variable duty cycle. To overcome this lack of a smooth transition, the hysteresis in the transition was created to prevent the "jitter" and produce a smooth transition.

Figure 8:
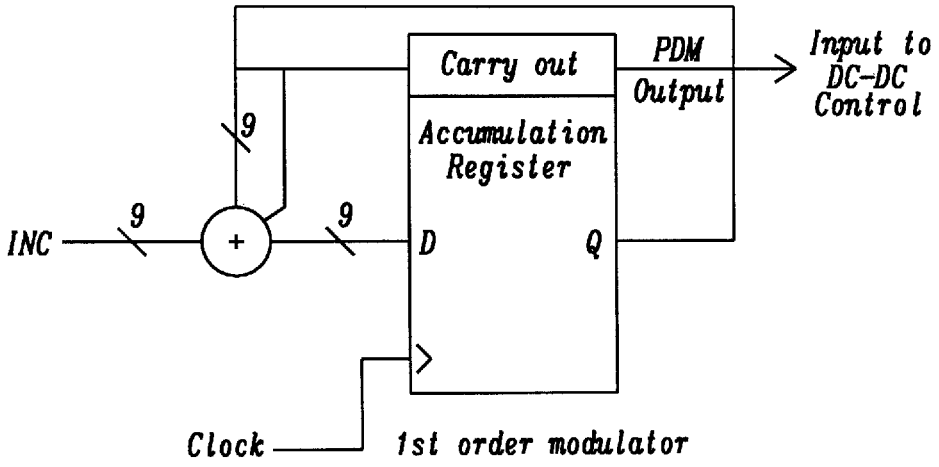
FIG. 8 is a block diagram of the present disclosure of a first order modulator.

Shown in FIG. 8 is a simple implementation of a $1^{st}$-order modulator to produce the PDM waveform. This structure uses the carry-out of the accumulator which automatically wraps-around on a $2^N$ count boundary. For this example the circuit has a 9-bit accumulator, the increment count value is given by the following formula:

$$DUTY = \frac{INC}{2^N} \times 100\% \text{ where } N = 9$$

The mathematical structure of a more general $1^{st}$ order modulator is expressed as follows, where the variables are defined as acc accumulator value
points number of clock points in the period, or size of accumulator
inc incrementing value, duty %*points
pdm pulse density waveform output

```
@(posedge clock)
    {
        acc = acc + inc
        if(acc > points)
            {
```

-continued

```
                acc = acc – points
                pdm = 1
            }
        else
            {
                pdm=0
            }
    }
```

While the disclosure has been particularly shown and described with reference to preferred embodiments thereof, it will be understood by those skilled in the art that various changes in form and details may be made without departing from the spirit and scope of the disclosure.

What is claimed is:

1. An LED light dimming circuit, comprising:

a) a string of at least one LED device;

b) a control circuit providing primary side regulation configured to produce drive current and modulation; and c) said control circuit configured to hold drive current constant at a predetermined level and varying a duty cycle of a pulse density modulator (PDM) to change LED device illumination, wherein said control circuit is configured to produce a hysteresis in the drive current between a fixed PDM duty cycle portion and a variable PDM duty cycle portion of the LED current to enable a smooth transition in emitted LED light.

2. The dimming circuit of claim 1, wherein said string of at least one LED device is coupled to a secondary side of a transformer which is configured to produce secondary side drive current and modulation.

3. The dimming circuit of claim 1, wherein said PDM is configured to create a majority of modulated energy at higher frequencies.

4. The dimming circuit of claim 3, wherein said PDM is a first-order modulator, which uses a carry-out of an accumulator and automatically wraps around on a $2^N$ count boundary.

5. The dimming circuit of claim 1, wherein said modulation is pulse width modulation (PWM).

6. The dimming circuit of claim 5, wherein said PWM configured to create a majority of modulated energy at lower frequencies.

7. A method to create an LED light dimming circuit, comprising:

a) coupling a control circuit to a primary side of a transformer, wherein the primary side is configured to receive power by an alternating voltage applied to a diode bridge circuit;

b) coupling a string of at least one LED device to a secondary side of the transformer; and c) controlling an illumination of the string of at least one LED device by said control circuit configured to change drive current from a maximum value to a predetermined level and then changing a duty cycle of a pulse density modulator (PDM) to further reduce current wherein said control circuit is configured to create a hysteresis at a transition between a fixed PDM duty cycle and a variable PDM duty cycle in the LED drive current to prevent a noticeable jump in brightness of light emanating from the at least one LED device.

8. The method of claim 7, wherein said PDM is configured to create a majority of modulated energy at high frequencies.

9. The method of claim 7, wherein said PDM is formed from a first-order modulator configured to a carry-out of an accumulator and to automatically wrap around on a $2^N$ count boundary.

10. The method of claim 7, wherein said modulator is a pulse width modulator (PWM).

11. The method of claim 10, wherein said PWM modulator is configured to create a majority of modulated energy at lower frequencies.

* * * * *